US005474241A

United States Patent [19]

Kennedy

[11] Patent Number: 5,474,241

[45] Date of Patent: Dec. 12, 1995

[54] PORTABLE APPARATUS FOR CREATING MULCH

[76] Inventor: Brian L. Kennedy, Rd. 2, Box 154, Mayport, Pa. 16240

[21] Appl. No.: 243,939

[22] Filed: May 17, 1994

[51] Int. Cl.[6] ..... B02C 18/06; B02C 18/16

[52] U.S. Cl. ..... 241/81; 241/100; 241/101.71; 241/199.12; 241/292.1

[58] Field of Search ..... 241/81, 100, 101.7, 241/199.12, 292.1

[56] References Cited

U.S. PATENT DOCUMENTS

| | | | |
|---|---|---|---|
| 2,963,229 | 12/1960 | Rhodes | 241/46 |
| 3,069,101 | 12/1962 | Wexell | 241/92 |
| 3,241,173 | 3/1966 | Finn | 15/328 |
| 4,360,166 | 11/1982 | Biersack | 241/92 |
| 4,477,029 | 10/1984 | Green | 241/101.7 |
| 4,593,863 | 6/1986 | Mordstein et al. | 241/92 |
| 4,640,465 | 2/1987 | Schmid | 241/37.5 |
| 4,778,117 | 10/1988 | Karg | 241/92 |
| 4,824,034 | 4/1989 | Baker | 241/101.2 |
| 4,858,834 | 8/1989 | Lanham | 241/85 |
| 4,984,747 | 1/1991 | Lechner | 241/55 |
| 5,199,653 | 4/1993 | Durrant et al. | 241/73 |
| 5,385,308 | 1/1995 | Gearing et al. | 241/101.7 |

FOREIGN PATENT DOCUMENTS

| | | | |
|---|---|---|---|
| 1034652 | 8/1983 | U.S.S.R. | 241/292.1 |

*Primary Examiner*—Mark Rosenbaum
*Assistant Examiner*—John M. Husar
*Attorney, Agent, or Firm*—David L. Baker; Henry S. Miller; Rhodes & Ascolillo

[57] ABSTRACT

A portable apparatus for mulching paper and paper products including a hopper having a gage bar limiting the thickness of the material entering the hopper, a cutting chamber where a cutter bar and a mulcher bar, operated by an electric motor, rotate and mulch the material and eject it into a chute and a bag at the end of the chute. The apparatus is easily clamped to a table.

6 Claims, 3 Drawing Sheets

PORTABLE APPARATUS FOR CREATING MULCH

BACKGROUND OF THE INVENTION

1. Field of the Invention

The invention relates generally to portable power equipment and in particular to a piece of power equipment that will create mulch from soft biodegradable products such as paper.

2. Description of the Prior Art

The field of light duty portable power equipment contains a wide variety of tools, most are special purpose as oppose to general purpose tools. The vast majority of ripping, grinding, and tearing tools are in the general area of forestry and brush working tools. For example, U.S. Pat. No. 3,069,101 issued Dec. 18, 1962 to Wexell and U.S. Pat. No. 4,858,834 issued Aug. 22, 1989 to Lanham both show wood chippers. Lanham improves the process by making the chips thinner then other wood and brush chippers. In general, wood chippers operate with a heavy fly wheel containing several cutting edges on the face and operate at high speed using momentum of the wheel as part of the cutting force. Since the product chipped is hard, this works effectively. If this style machine was used on a soft product the machine would soon jam and the flywheel would be brought to an abrupt stop.

A general purpose machine is seen in U.S. Pat. No. 3,241,173 issued Mar. 22, 1966 to Finn. The Finn machine consists of a gasoline powered blower which converts into a vacuum fan and a system for blowing mulch. These machines are often seen behind landscaper's trucks and are distinguished from the instant invention in that they simply blow hay and straw mulch on freshly seeded areas. This machine does not create mulch, the mulch comes in bails that are opened by an operator who feeds mulch into a hopper. A type of chipper/shredder is shown in U.S. Pat. No. 5,199,653 issued Apr. 6, 1993 to Durrant et al. The patent concerns the discharge assembly without details to the chipper however, the appearance of the side inlet chute implies that it is of the heavy fly wheel type and could not handle soft material products.

A different aspect of grinding, ripping and tearing is seen in the garbage grinder feeder disclosed in U.S. Pat. No. 2,963,229 issued Dec. 6, 1960 to Rhodes. The patent discloses three point or star shaped spiders for breaking, crushing and grinding the waste product in order that it will flow from the hopper into the main grinder. The device is powered by electric motors but fails to show the structure of the instant invention.

SUMMARY OF THE INVENTION

The invention is a power equipment size tool which creates mulch that may be used on gardens and flower beds. The invention is designed primarily to mulch paper and paper products but the invention is not intended to be limited thereby as other products may likewise be effectively mulched. The invention is distinguished from the common paper shredder in that the mulch created is in pieces of large and irregular size which could be easily reassembled and defeat the purpose of security inherent in the use of the paper shredder.

The invention has a hopper with a relatively large end covered in part by a protective screen but with a gauge bar that will only allow materials of a certain thickness or less pass. The hopper generally funnels down to the cutting chamber where the material engages the rotating cutting and mulching bars. The bars are mounted on the end of an electric motor shaft and rotate approximately 1750 revolutions per minute in the counterclockwise direction. The bars are at right angles, one bar containing six cutting blades and the other bar containing four mulching teeth. The lower edge of the hopper acts as a stationary cutting blade. A chute is positioned below the cutting chamber and directs the mulch out and away from the cutting chamber. A bag is generally connected to the output of the chute at points provided although it is not necessary for the operation of the device.

The electric motor used to drive the cutting and mulching tool may be a 110 volt A.C., single phase, 60 hertz type, with a one horse power rating. Larger motors may be used as effectively for mulching but larger motors will limit the mobility of the invention.

It is therefore an object of the invention to provide a new and improved portable apparatus for creating mulch.

It is another object of the invention to provide a new and improved portable apparatus for creating mulch that will effectively and efficiently mulch soft biodegradable material.

It is a further object of the invention to provide a new and improved apparatus for creating mulch that is light in weight and portable.

It is still another object of the invention to provide a new and improved apparatus for creating mulch that is safe and free of mechanical hazards.

It is another object of the invention to provide a new and improved apparatus for creating mulch that is low in cost and highly reliable.

It is another object of the invention to provide a new and improved apparatus for creating mulch that is of a durable and reliable construction.

These and other advantages, features and objects of the invention will become more apparent from the following description taken in connection with the illustrative embodiment in the accompanying drawings.

DESCRIPTION OF A PREFERRED EMBODIMENT

Figure 1:
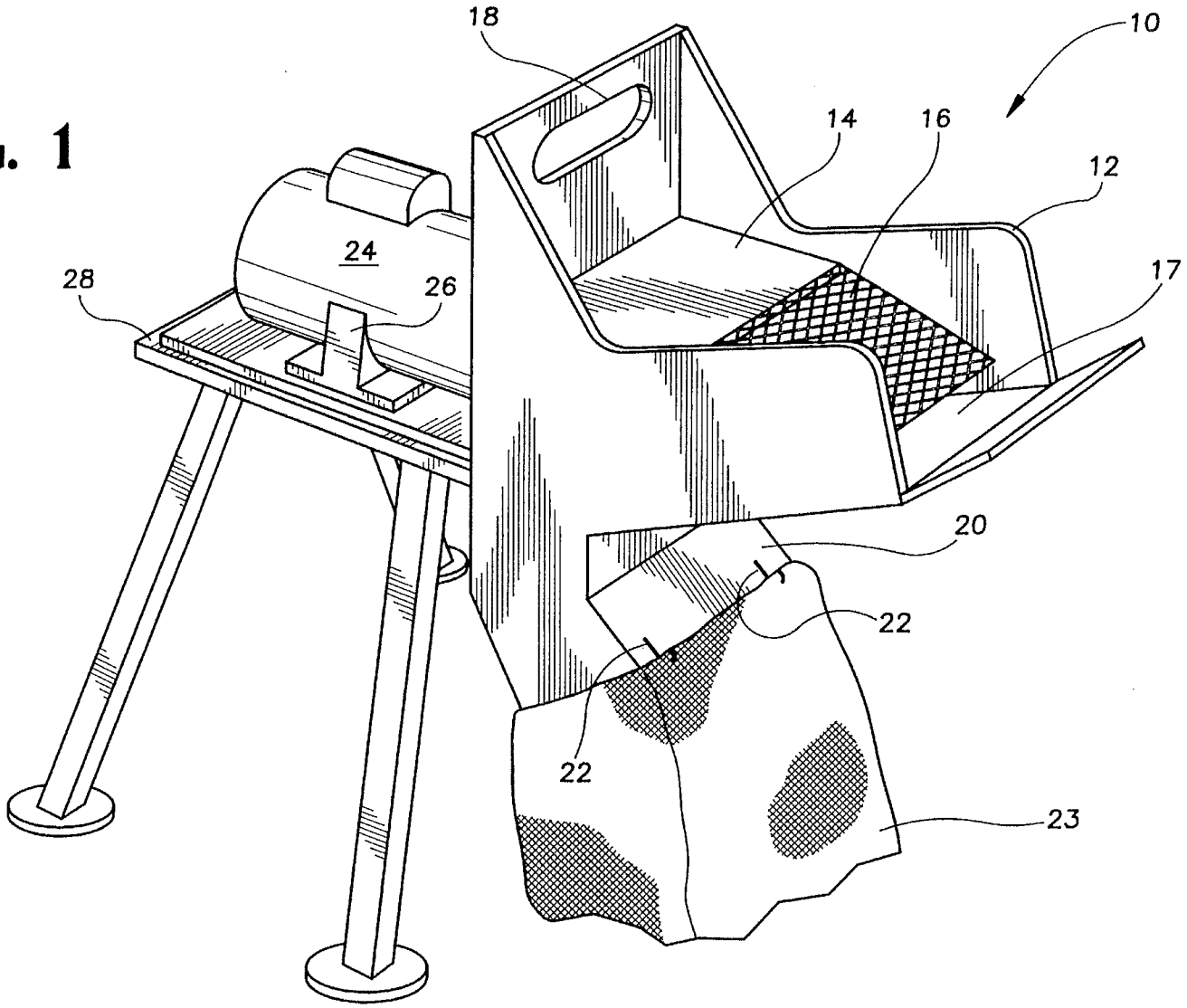
FIG. 1 is a perspective view of the invention.

Referring now to FIG. 1, the invention is shown generally at 10. The hopper 12 consists of the protective plate 14 and protective screen 16. Material entry area 17 is limited by a gage bar mounted on the screen 16. The rear wall of the hopper contains a handle 18 for moving the apparatus from place to place. A chute 20 directs the mulch from the cutting chamber, located between the hopper and the chute, into a container, such as a burlap bag 23, which is secured by fasteners 22. An electric motor 24 is mounted in a universal fixture 26 which is secured by a conventional means to the table 28.

Figure 2:
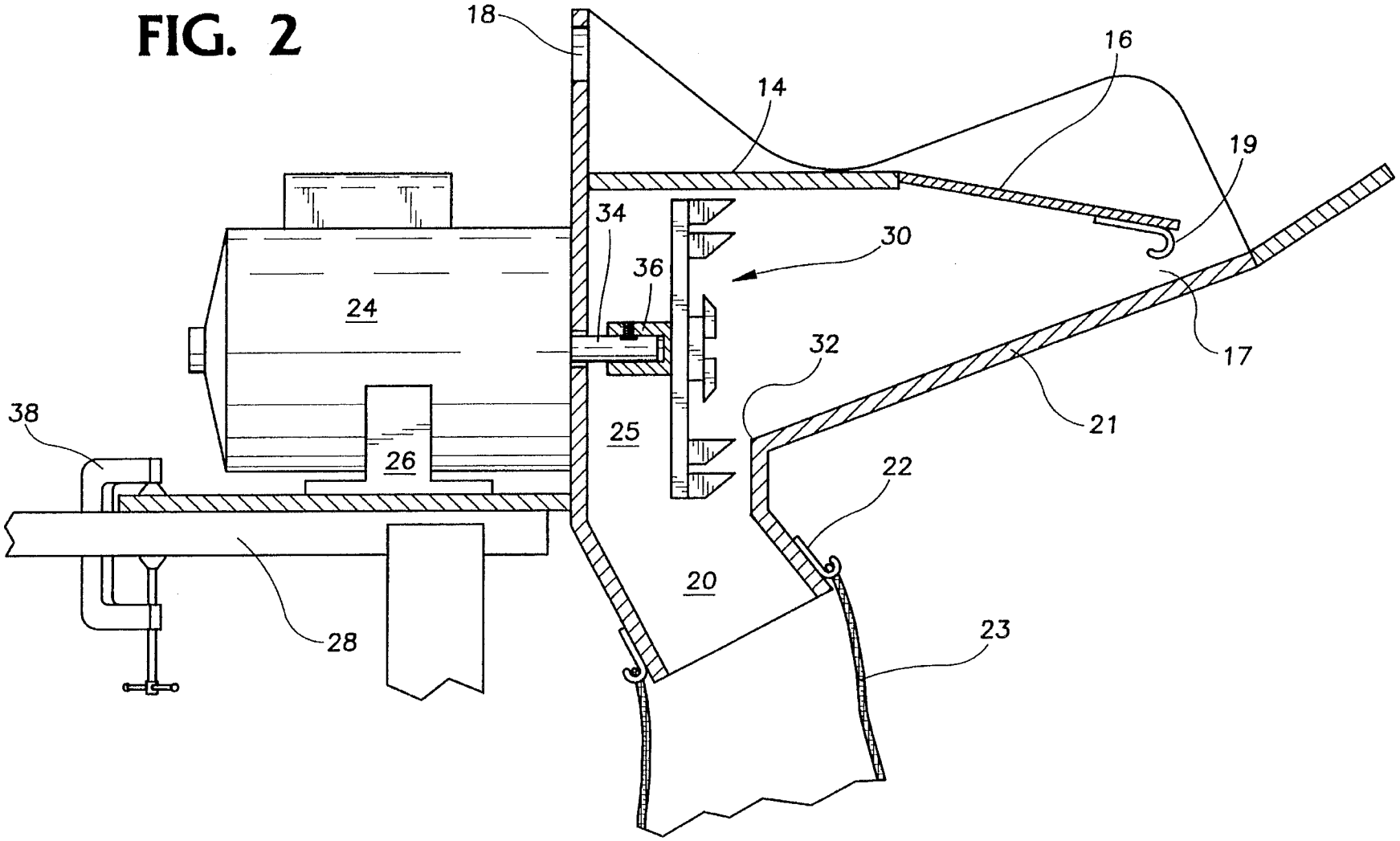
FIG. 2 is a side elevation view, partly in section of the invention.

Concerning FIG. 2, paper is allowed to enter the hopper via the slot like entry area 17. Gage bar 19 limits the thickness of the input material to 3/16 of one inch in thickness. The material slides down the hopper surface 21 until it reaches the cutting chamber 25. The cutting and mulching bars shown generally at 30 pull the material from the hopper and, using edge 32 as an additional cutting surface, cut and mulch the material blowing the finished product down the chute 20 and into the bag 23. The cutting and mulching bars are connected to the electric motor shaft 34 by connecting union 36. Universal mounting plate 26 is secured to table 28 by means of a conventional clamp 38.

Figure 3:
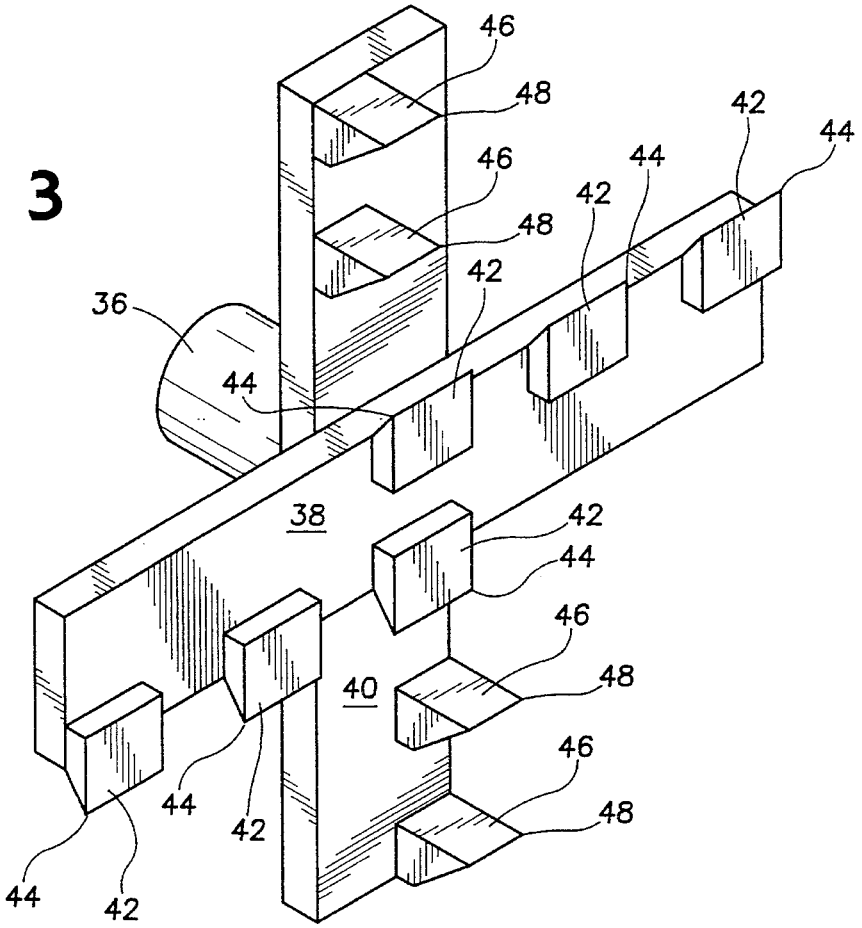
FIG. 3 is a perspective view of the cutting and mulching bars of the invention.

FIG. 3 shows cutting bar 38 and mulcher bar 40 transversely mounted. The cutter bar contains six cutting blades 42 with cutting edge 44. The mulching bar contains four mulching teeth 46 with edges 48. In operation, the cutting blades operate within one half inch of the edge (32) of the hopper surface 21. The material is cut by the blades 42 and then mulched by the transversely mounted mulching blades 46 as the cut material, not moving as fast as the rotating cutting and mulching bars, is repeatedly cut and ripped apart as it travels around the cutting chamber before being blown into the outlet chute(20).

The cutting and mulching bars are welded and balanced prior to operation. The cutting blades and mulching teeth are formed of T-1 tungsten steel or other suitable material.

Figure 4:
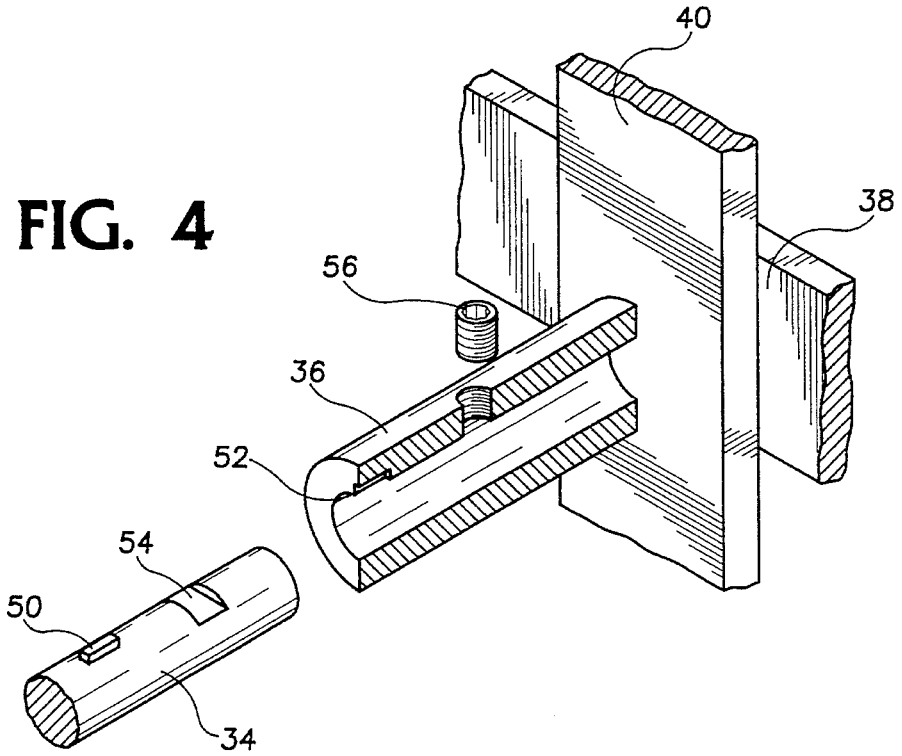
FIG. 4 is a perspective view, partly in cross section, of the connecting union between the motor and the cutting and mulching bars.

In FIG. 4, the union 36 is connected to mulcher bar 40 by welding and in turn bar 40 is connected to cutter bar 38 by welding. The motor shaft 34 is secured to the union by a key 50 which engages key way 52 and a flat 54 which receives the allen type set screw 56. The union and the shaft are secured then both longitudinally and rotationally.

The success of the invention is seen in the use of mounting the cutting and mulching means on bars rather than the more conventional wheel or disk arrangements. The bars allow the material to float in the cutting chamber and exposing it to more strokes from the bars from different angles.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A portable apparatus for creating mulch from soft biodegradable material products comprising:

a hopper, having an input end and an output end;

a chamber in the hopper;

means for cutting and means for mulching, in the chamber, in operative association with the output of the hopper;

the means for cutting and means for mulching being cross shaped;

the means for cutting and means for mulching comprise a cutting and mulching tool, having tungsten steel blades for cutting and tungsten steel teeth for mulching;

an output chute means, attached to the hopper output end, for directing discharged cut and mulched material from the chamber;

a protective plate attached to the hopper;

a protective screen attached to the protective plate;

and gage bar, attached to the protective screen, limiting the thickness of the material entering the hopper; and a driving means, connected to the means for cutting and means for mulching for turning the means for cutting and means for mulching.

2. An apparatus for creating mulch from soft material according to claim 1 wherein the material is limited to a thickness of 3/16 inches.

3. An apparatus for creating mulch from soft material according to claim 1 wherein the driving means is an electrically powered motor.

4. An apparatus for creating mulch from soft material according to claim 3 wherein: the motor driving means is connected directly to the cutting and mulching tool.

5. An apparatus for creating mulch from soft material according to claim 4 including means fixed to the said chute means for securing a mulch collection means.

6. An apparatus for creating mulch from soft material according to claim 1 wherein: the blades for cutting and the teeth for mulching include a plurality of blades and a plurality of teeth located in spaced relation on arms that cross at a central point and are oriented at 90 degrees to the other and rotate about a common axis in parallel vertical planes.

* * * * *